US006212995B1

(12) United States Patent
Hasegawa et al.

(10) Patent No.: US 6,212,995 B1
(45) Date of Patent: Apr. 10, 2001

(54) VARIABLE-DISPLACEMENT INCLINED PLATE COMPRESSOR

(75) Inventors: Yutaka Hasegawa, Maebashi; Hideharu Hatakeyama, Isesaki, both of (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 09/417,316

(22) Filed: Oct. 13, 1999

(30) Foreign Application Priority Data

Oct. 14, 1998 (JP) ..... 10-292304

(51) Int. Cl.[7] ..... F04B 27/08
(52) U.S. Cl. ..... 92/71; 92/169.1
(58) Field of Search ..... 92/12.2, 71, 169.1

(56) References Cited

U.S. PATENT DOCUMENTS 172,102 * 1/1876 Ellis ..... 92/169.1 X
3,809,506 * 5/1974 Malcosky ..... 92/169.1 X
3,999,894 * 12/1976 Nakayama et al. ..... 92/128 X
4,784,045 * 11/1988 Terauchi ..... 92/71
5,149,254 * 9/1992 Riffe ..... 92/181 R X

FOREIGN PATENT DOCUMENTS 2-80862 * 3/1990 (JP) ..... 92/169.1
7-91366 4/1995 (JP) .

* cited by examiner

*Primary Examiner*—John E. Ryznic
(74) *Attorney, Agent, or Firm*—Baker Botts L.L.P.

(57) ABSTRACT

A variable-displacement inclined plate compressor includes a crank chamber defined by a cylinder block and a front housing connected to the cylinder block. The cylinder block has cylinder bores, each opening toward the crank chamber. A rounded edge of each cylinder bore extends circumferentially around the cylinder bore at a crank chamber-side axial end of the cylinder bore. By the formation of the rounded edge of the cylinder bore, the sliding resistance of the piston may decrease. The decreased sliding resistance may prevent the piston coating from being scratched. Further, the decreased sliding resistance may decrease the load on the compressor, thereby achieving a smooth control of the inclination angle of the inclined plate.

7 Claims, 4 Drawing Sheets

CYLINDER HEAD SIDE
CRANK CHAMBER SIDE
a
1b
8
1d
8a
Δx
1a
8b
c
l

VARIABLE-DISPLACEMENT INCLINED PLATE COMPRESSOR

BACKGROUND OF THE INVENTION

1. Field of the Invention

The present invention relates to a variable-displacement inclined plate compressor, and, more specifically, to a variable-displacement inclined plate compressor with an improved structure of cylinder bores of a cylinder block suitable, for use in a refrigerating cycle of an air conditioner for vehicles.

2. Description of Related Art

Variable-displacement inclined plate compressors are known in the art. A known structure of a variable-displacement inclined plate compressor is constructed as depicted in FIG. 4, and such a compressor structure is disclosed, for example, in JP-A-7-91366. In FIG. 4, front housing 2 is connected to the front side of cylinder block 1, and rear housing 3 is connected to the rear side of cylinder block 1 via valve plate 4. A crank chamber 5 is defined by cylinder block 1 and front housing 2. A drive shaft 6, extending in its axial direction X, is disposed in crank chamber 5. Drive shaft 6 is rotatably supported by bearings 7*a* and 7*b*. Cylinder bores 8 are defined in cylinder block 1 around a central bore 41, into which one end of drive shaft 6 is inserted. Pistons 9 are slidably inserted into the respective cylinder bores 8.

Rotor 10 is fixed onto drive shaft 6 in crank chamber 5. Rotor 10 rotates synchronously with the rotation of drive shaft 6. Rotor 10 is rotatably supported by bearing 7*c* relative to front housing 2. Inclined plate 11 is provided around drive shaft 6 at a rear side of rotor 10 in crank chamber 5. Drive shaft 6 is inserted into a through hole 20 defined at the center of inclined plate 11. Supporting portion 20*a* is formed in through hole 20. Inclined plate 11 is supported on drive shaft 6 via supporting portion 20*a*, so that inclined plate 11 may be slid along axial direction X of drive shaft 6 and rotated synchronously with the rotation of drive shaft 6. Spring 12 is interposed between rotor 10 and inclined plate 11. Spring 12 urges inclined plate 11 in the direction toward rear housing 3.

Semi-spherical shoe 14 is provided between the radially outer portion of inclined plate 11 and each piston 9. Shoe 14 connects inclined plate 11 and each piston 9 by the slidable engagement of shoe 14 with the side surfaces of inclined plate 11 and the spherical inner surface of each piston 9. Thus, respective pistons 9, slidably engaged with inclined plate 11 via respective shoes 14, may be reciprocally moved in respective cylinder bores 8. Hinge mechanism K is provided on the front side of inclined plate 11. Hinge mechanism K has a pair of brackets 15 positioned at both sides of top dead center position T of inclined plate 11. A first end of guide pin 16 is fixed to each bracket 15, and a second end of guide pin 16 is formed as a spherical portion 16*a*.

A pair of supporting arms 17 are provided on rotor 10, so that each supporting arm 17 slidably engages corresponding guide pin 16. These supporting arms 17 form the remaining part of hinge mechanism K. Guide hole 17*a* is defined on the tip portion of each supporting arm 17. Guide hole 17*a* extends in parallel to a plane defined by axis X of drive shaft 6 and top dead center position T of inclined plate 11, and extends straight in a direction approaching from radially outside of axis X of drive shaft 6. The axial directions of respective guide holes 17*a* are set, so that top dead center position T of piston 9 does not vary significantly in the front/rear direction despite the inclination of inclined plate 11. Respective spherical portions 16*a* of respective guide pins 16 are inserted rotatably and slidably into respective guide holes 17*a*.

When spring 12 is at its maximum extension, rear end recess 11*b* of inclined plate 11, which is formed at the rear end of through hole 20, comes into contact with C-clip 13 engaged on drive shaft 6. By this contact, inclined plate 11 is restricted from further movement in an inclination angle decreasing direction. When spring 12 is fully contracted, front end surface 11*a* of inclined plate 11, which is formed at the lower front side surface of inclined plate 11 as an inclined surface, comes into contact with rear end surface 10*a* of rotor 10. By this contact, inclined plate 11 is restricted from further movement in an inclination angle increasing direction.

The interior of rear housing 3 is divided into suction chamber 30 and discharge chamber 31. Suction port 32 and discharge port 33 are opened on valve plate 4 in correspondence with each cylinder bore 8. A compression chamber, formed between valve plate 4 and piston 9, may communicate with suction chamber 30 and discharge chamber 31 via suction port 32 and discharge port 33. A control valve (not shown) is provided on each suction port 32 to control the opening and closing of suction port 32. A control valve (not shown) is provided also on each discharge port 33 to control the opening and closing of discharge port 33. The opening operation of the control valve for discharge port 33 is restricted by retainer 34. Further, a pressure control valve (not shown) is provided between suction chamber 30 and crank chamber 5 to control the pressure in crank chamber 5.

In such a variable-displacement inclined plate compressor, when inclined plate 11 rotates in accompaniment with the rotation of drive shaft 6, the driving force is transmitted to each piston 9 via each shoe 14, and each piston 9 reciprocally moves in each cylinder bore 8. By the reciprocal motion of each piston 9, gas, for example, refrigerant gas, is sucked from suction chamber 30 into a compression chamber through suction port 32. The gas is compressed in the compression chamber. The compressed gas is discharged into discharge chamber 31 through discharge port 33. During this operation, the volume of the compressed gas discharged into discharge chamber 31 is controlled by the controlling pressure in crank chamber 5 due to the pressure control valve.

When the above-described compressor is assembled, in order to facilitate the insertion of piston 9 and piston rings attached thereon into cylinder bore 8 of cylinder block 1, generally front edge 1*b* of cylinder bore 8 may be chamfered as a straight-line tapered, chamfered portion. However, in such a straight-line tapered, chamfered portion, the end of the tapered, chamfered portion and a connecting portion of a cylinder liner may be formed as a relatively sharp corner portion. If such a corner portion exists, the sliding resistance of piston 9 against a radial pressing force, generated particularly when piston 9 moves from the bottom dead center position toward the top dead center position, may increase. Such an increase of the sliding resistance of piston 9 may result in the generation of scratches on the surface of the coating of piston 9. Further, an excessive load caused by the sliding resistance of piston 9 may adversely affect the control of the inclination of inclined plate 11, thereby reducing the durability of inclined plate 11.

SUMMARY OF THE INVENTION

Accordingly, it is an object of the present invention to provide an improved structure for a variable-displacement inclined plate compressor that may decrease the sliding resistance of a piston, generated in accompaniment with the reciprocating motion of the piston, and may prevent the piston coating from being scratched, thereby smoothly controlling the inclination angle of an inclined plate by a reduced load.

To achieve the foregoing and other objects, a variable-displacement inclined plate compressor according to the present invention is herein provided. The variable-displacement inclined plate compressor includes a crank chamber defined by a cylinder block and a front housing connected to the cylinder block. The cylinder block has a central bore, into which a drive shaft is inserted, and a plurality of cylinder bores defined around the central bore and opening toward the crank chamber. The compressor further comprises an edge formed on each cylinder bore and extending circumferentially around the cylinder bore at a crank chamber-side axial end of the cylinder bore. The edge is formed as a rounded surface. Particularly, the edge may be formed as a convex surface in its cross section.

The rounded edge may be formed on a circumferential portion of the cylinder bore, preferably except at the connecting portion of the cylinder block with the front housing. Further, the rounded edge preferably has a predetermined radius of curvature. Desired relationships between the radius of curvature, an radial width, and an axial length of the rounded edge will be described later.

In the variable-displacement inclined plate compressor, because the edge of each cylinder bore at the crank chamber-side axial end of the cylinder bore is formed as a rounded surface, i.e., a rounded corner, the sliding resistance of the piston against a radial pressing force, which is generated when the piston moves from the bottom dead center position toward the top dead center position, may decrease. By reducing the sliding resistance, scratching the piston coating may be avoided. Moreover, the decreased sliding resistance may reduce the load on the compressor. The reduced load may achieve a smooth control of the inclination angle of the inclined plate. Consequently, the heating value and the consumed power of the compressor may decrease, and the durability of the compressor may increase. Further, the ease of assembly of the pistons into the cylinder bores also may be ensured by the improved structure of the rounded surface edges.

Further objects, features, and advantages of the present invention will be understood from the following detailed description of a preferred embodiment of the present invention with reference to the accompanying figures.

BRIEF DESCRIPTION OF THE DRAWINGS

An embodiment of the invention is now described with reference to the accompanying figures, which is given by way of example only, and is not intended to limit the present invention.

DETAILED DESCRIPTION OF A PREFERRED EMBODIMENT

Figure 1:
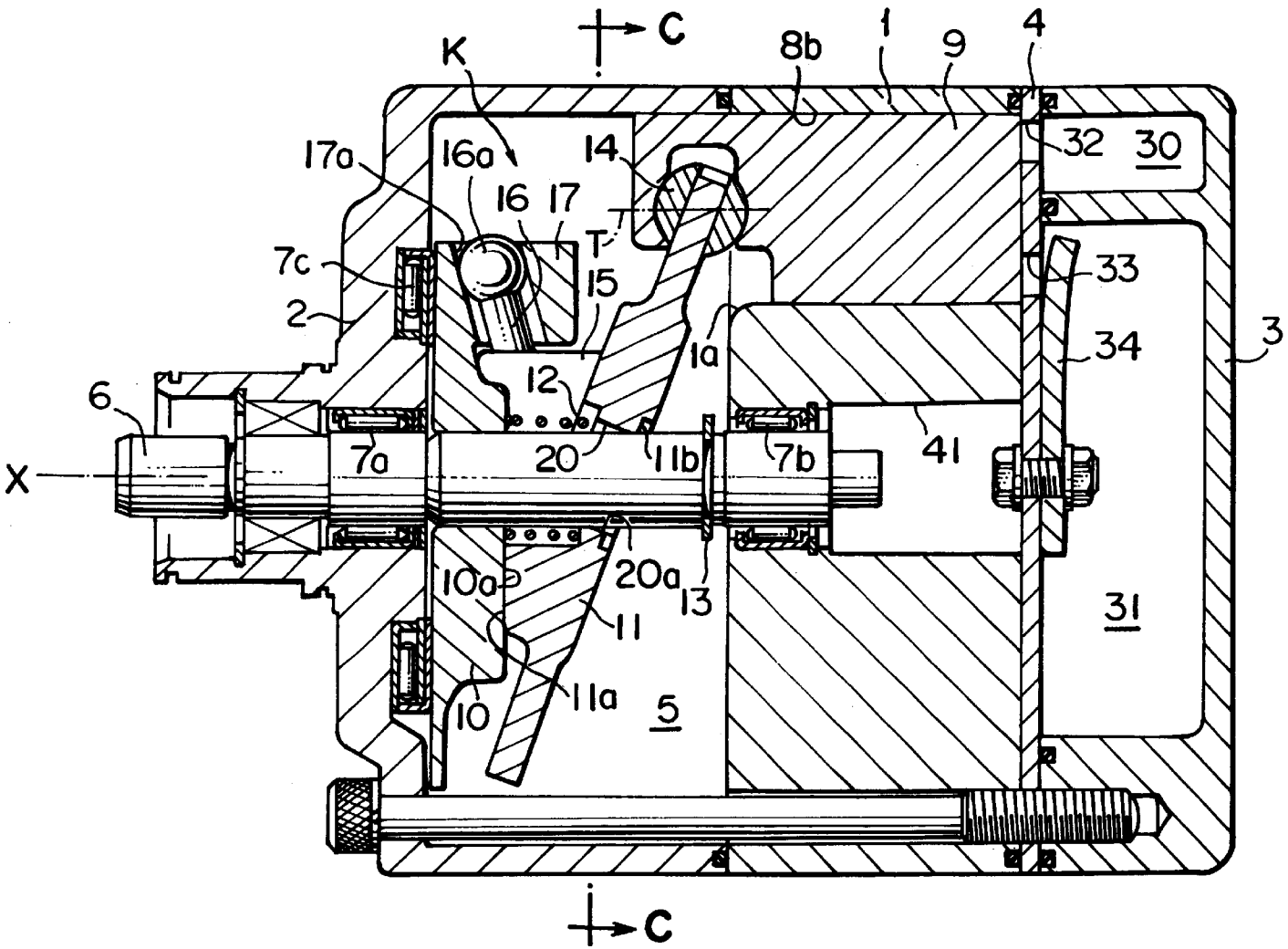
FIG. 1 is a vertical, cross-sectional view of a variable-displacement inclined plate compressor according to an embodiment of the present invention.
Figures 1, 2, 3:
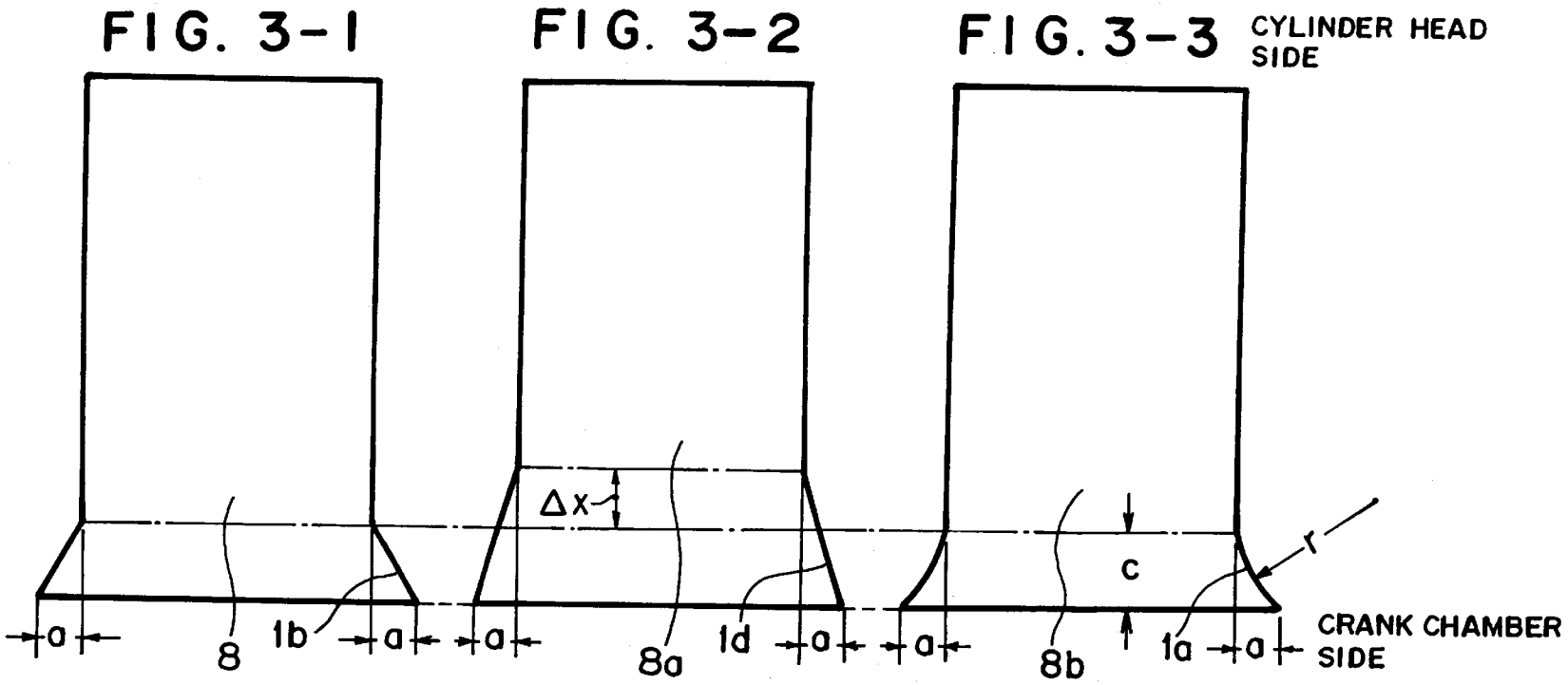
FIG. 3 is a comparison view showing schematic plan views of a cylinder bore according to the present invention (FIG. 3-3) and known cylinder bores (FIGS. 3-1 and 3-2).
Figure 4:
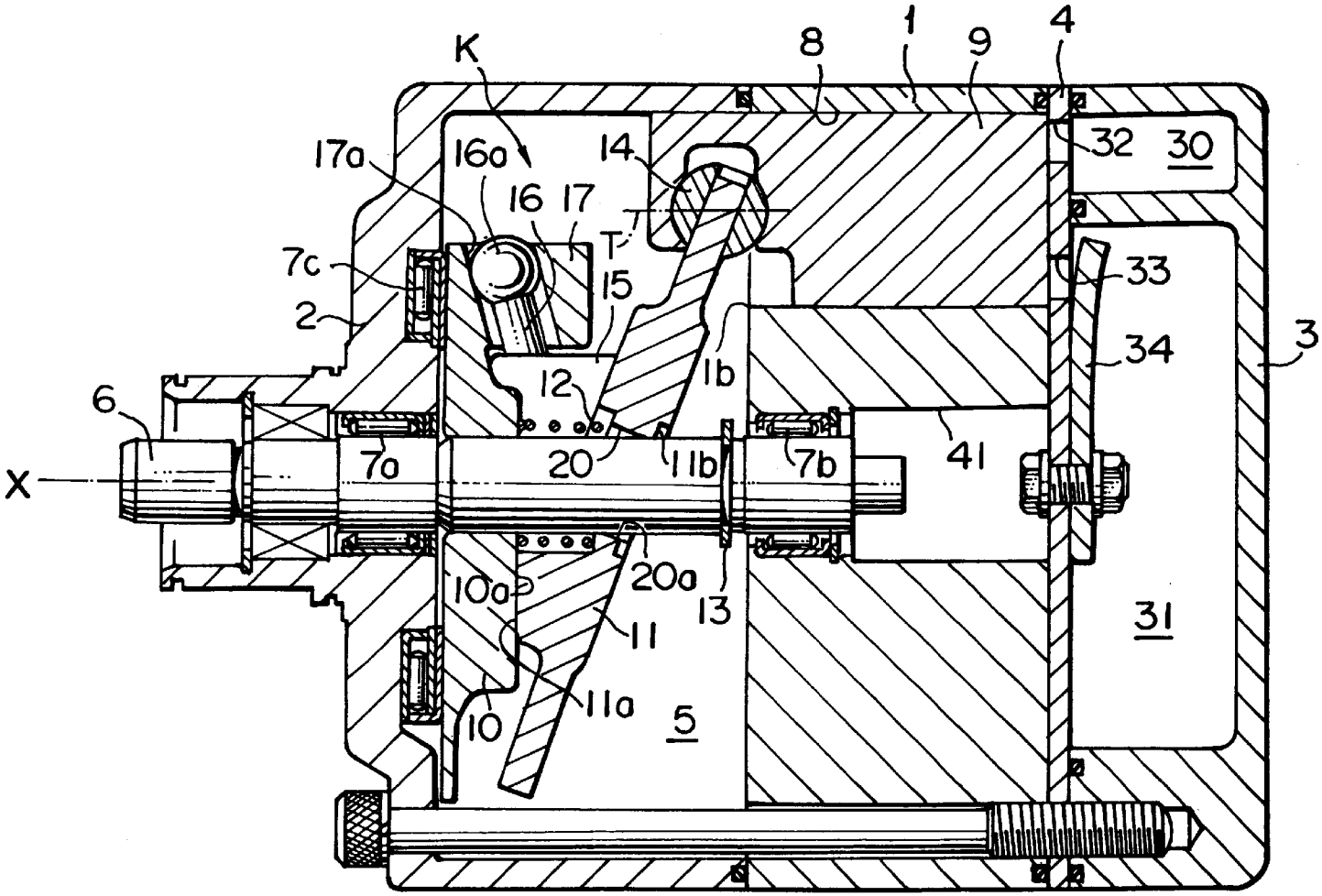
FIG. 4 PRIOR ART
FIG. 4 is a vertical, cross-sectional view of a known variable-displacement inclined plate compressor.

Referring to FIGS. 1 and 2, a variable-displacement inclined plate compressor according to an embodiment of the present invention is provided. In FIG. 1, the structure of cylinder bore 8*b* having crank chamber-side edge la defined in cylinder block 1 is different from that of cylinder bore 8 having crank chamber-side edge 1*b* depicted in FIG. 4. The structures of the other portions basically are the same as those of the known compressor depicted in FIG. 4. Therefore, the explanation of the other portions is omitted by providing the same labels to the other portions of FIG. 1, as those depicted in FIG. 4.

In this compressor, a plurality of cylinder bores 8*b* are defined in cylinder block 1 around central bore 41. One end portion of drive shaft 6 is inserted into central bore 41. Crank chamber 5 is defined by cylinder block 1 and front housing 2. Edge 1*a* of each cylinder bore 8*b* extends circumferentially around the cylinder bore 8*b* at a crank chamber-side axial end of the cylinder bore 8*b*. Edge 1*a* of each cylinder bore 8*b* is adjacent to crank chamber 5. Each edge 1*a* is formed as a rounded surface forming a rounded corner.

Figure 2A:
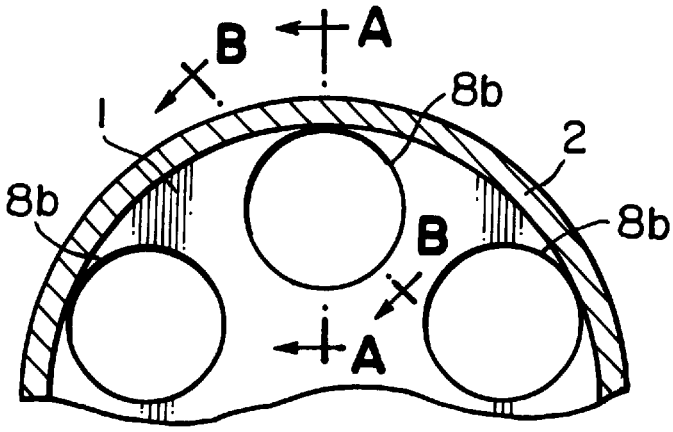
FIG. 2A is a partial, elevational view of a cylinder block and a front housing of the compressor depicted in FIG. 1, as viewed along line C—C of FIG. 1 with the pistons removed.
Figure 2B:
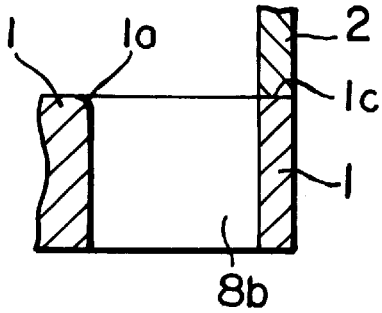
FIG. 2B is a partial, cross-sectional view of the cylinder block and the front housing of the compressor depicted in FIG. 2A, as viewed along line A—A of FIG. 2A.
Figure 2C:
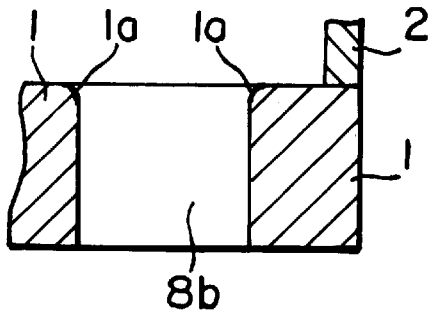
FIG. 2C is a partial, cross-sectional view of the cylinder block and the front housing of the compressor depicted in FIG. 2A, as viewed along line B—B of FIG. 2A.

FIGS. 2A–2C depict the configuration of cylinder bore 8*b* and rounded edge 1*a*. As depicted in FIGS. 2B and 2C, edge 1*a* is formed as a rounded surface on a circumferential portion of edge 1*a* except a connecting portion 1*c* of cylinder block 1 with front housing 2. In other words, edge 1*a* formed as a rounded surface extends in a circumferential direction almost over its entire length, except for connecting portion 1*c*.

FIG. 3 depicts the configuration of cylinder bore 8*b* as compared to the configurations of known cylinder bores 8 and 8*a*. In known cylinder bore 8 depicted in FIG. 3-1, crank chamber-side edge 1*b* of cylinder bore 8 is formed as a straight-line tapered, chamfered portion. The straight-line tapered, chamfered portion has a radial width "a" to facilitate insertion of piston 9 into cylinder bore 8 during assembly of the compressor. In this structure, however, the end of the tapered, chamfered portion and a connecting portion of a cylinder liner (substantially the same portion) is formed as a relatively sharp corner portion. If such a corner portion exists, the sliding resistance of piston 9 against a radial pressing force, generated particularly when piston 9 moves from the bottom dead center position toward the top dead center position, may increase.

In known cylinder bore 8*a* depicted in FIG. 3-2, crank chamber-side edge 1*d* of cylinder bore 8*a* is formed as a straight-line tapered, chamfered portion, so that the axial length of the taper chamfered portion is lengthened by $\Delta x$ as compared with edge 1*b*. In this structure, however, the axial length of cylinder bore 8*a* for supporting piston 9 decreases by $\Delta x$. Therefore, although the problems originating from the above-described relatively sharp corner portion may be reduced, by the decrease of the supporting length of cylinder bore 8*a* for supporting piston 9, the inclination of piston 9 within cylinder bore 8*a* may increase. Such a condition may adversely effect control of compression.

In the improved structure according to the present invention depicted in FIG. 3-3, crank chamber-side edge 1*a* of cylinder bore 8*b* is formed as a rounded surface convex toward the interior of cylinder bore 8*b* having a predetermined desired radius of curvature "r". This rounded edge 1*a* is formed within the radial width "a" to facilitate insertion of piston 9 into cylinder bore 8*b* in the assembly of the compressor. The predetermined radius of curvature "r" and the radial width "a" of rounded edge 1*a* preferably satisfy an equation of $r \geqq a$. Further, the radial width "a" of rounded edge 1*a* and an axial length "c" of rounded edge 1*a* preferably satisfy an equation of $c \geqq a$. Preferably, the radius of curvature "r" is determined such that $c \geqq a$ is achieved. Thus, in this improved structure, a sharp corner portion is not formed. Because a sharp corner portion is not formed on crank chamber-side edge 1*a* of cylinder bore 8*b*, the sliding resistance of piston 9 against a radial pressing force, which is generated when piston 9 moves from the bottom dead center position toward the top dead center position, may decrease. In addition, the reduced sliding resistance may prevent the piston coating from being scratched. Moreover, the decreased sliding resistance may reduce the load on the compressor. The reduced load may achieve a smooth control of the inclination angle of inclined plate 11. Consequently, the heating value and the consumed power of the compressor may decrease, and the durability of the compressor may increase.

Further, because rounded edge 1*a* is formed within the desired radial width "a" without an accompanying decrease in the supporting length for piston 9, excessive inclination of piston 9 in cylinder bore 8*b* may be avoided, and a desired control of compression may be accomplished. Of course, the ease of assembly of pistons 9 into cylinder bores 8*b* also may be ensured by providing rounded edges 1*a* to respective cylinder bores 8*b*.

Although only one embodiment of the present invention has been described in detail herein, the scope of the invention is not limited thereto. It will be appreciated by those skilled in the art that various modifications may be made without departing from the scope of the invention. Accordingly, the embodiment disclosed herein is only exemplary. It is to be understood that the scope of the invention is not to be limited thereby, but is to be determined by the claims which follow.

What is claimed is:

1. A variable-displacement inclined plate compressor including a crank chamber defined by a cylinder block and a front housing connected to said cylinder block, said cylinder block having a central bore, into which a drive shaft is inserted, and a plurality of cylinder bores defined around said central bore and opening toward said crank chamber, said compressor comprising:

a rounded edge of each of said cylinder bores extending circumferentially around each of said cylinder bores at a crank chamber-side, axial end of each of said cylinder bores.

2. The variable-displacement inclined plate compressor of claim 1, wherein said rounded edge is formed as a convex surface in cross section.

3. The variable-displacement inclined plate compressor of claim 1, wherein said rounded edge is formed on a circumferential portion of said cylinder bore.

4. The variable-displacement inclined plate compressor of claim 3, wherein said rounded edge is formed on said circumferential portion, except at a connecting portion of said cylinder block with said front housing.

5. The variable-displacement inclined plate compressor of claim 1, wherein said rounded edge has a predetermined radius of curvature.

6. The variable-displacement inclined plate compressor of claim 5, wherein said predetermined radius of curvature of said rounded edge "r" and a radial width of said rounded edge "a" satisfy an equation of $r \geqq a$.

7. The variable-displacement inclined plate compressor of claim 6, wherein said radial width of said rounded edge "a" and an axial length of said rounded edge "c" satisfy an equation of $c \geqq a$.

* * * * *